US005557901A

United States Patent [19]

Hoosic et al.

[11] Patent Number: 5,557,901

[45] Date of Patent: Sep. 24, 1996

[54] BOILER BUCKSTAY SYSTEM

[75] Inventors: Thomas P. Hoosic, Clinton; Edward F. Radke, Wadsworth, both of Ohio

[73] Assignee: The Babcock & Wilcox Company, New Orleans, La.

[21] Appl. No.: 339,852

[22] Filed: Nov. 15, 1994

[51] Int. Cl.[6] ..... E04B 2/28; F22B 37/24

[52] U.S. Cl. ..... 52/506.03; 52/219; 52/506.02; 52/573.1; 122/6 A; 122/510; 122/235.12; 122/DIG. 16; 165/81

[58] Field of Search ..... 52/506.02, 506.03, 52/506.06, 573.1, 219; 122/510, 511, 512, DIG. 16, 6 A, 235.12; 165/81, 162

[56] References Cited

U.S. PATENT DOCUMENTS

| | | | |
|---|---|---|---|
| 2,333,777 | 11/1943 | Godshalk . | |
| 2,655,238 | 10/1953 | Langvand . | |
| 2,700,375 | 1/1955 | Godshalk et al. . | |
| 2,773,487 | 12/1956 | Walter et al. . | |
| 2,948,267 | 8/1960 | Koch et al. . | |
| 3,007,455 | 11/1961 | Lieb et al. . | |
| 3,173,405 | 3/1965 | Evans . | |
| 3,301,225 | 1/1967 | Boe et al. . | |
| 3,479,994 | 11/1969 | Kreider et al. . | |
| 4,008,691 | 2/1977 | Kreider et al. . | |
| 4,059,075 | 11/1977 | Ssineguraki et al. . | |
| 4,240,234 | 12/1980 | Eisinger et al. | 122/6 A X |
| 4,395,860 | 8/1983 | Semyanko . | |
| 4,499,860 | 2/1985 | Loomis et al. . | |
| 4,512,336 | 4/1985 | Wiener | 122/235.12 X |
| 4,721,069 | 1/1988 | Kreider . | |
| 5,136,985 | 8/1992 | Krowech . | |
| 5,207,184 | 5/1993 | Kreider . | |
| 5,299,535 | 4/1994 | Payne | 122/6 A X |
| 5,317,993 | 6/1994 | Payne | 122/6 A X |

OTHER PUBLICATIONS

B&W Plant Service Bulletin PSB–28 2M P Jan. 1988–"Membraned Wall Corner Tube Failures", The Babcock & Wilcox Company. Entire paper.

*Steam: its generation and use,* ©1975, The Babcock & Wilcox Company, pp. 12–5, 12–6, 16–1 to 16–9, 17, 17–1.

*Primary Examiner*—Carl D. Friedman
*Assistant Examiner*—Christopher Todd Kent
*Attorney, Agent, or Firm*—Robert J. Edwards; Eric Marich

[57] ABSTRACT

A buckstay system for a membraned-tube wall of a steam generator having a first wall section which meets a second wall section at an angle to form a corner. At least one buckstay extends across at least part of each wall section. A pair of tie bars are welded to each other at the corner, an end connection corner tie is welded at the corner to the pair of tie bars, and a pair of end connection buckstay brackets are welded to each end of the buckstays. A pair of pinned end connection links, an end connection corner tie and the end connection buckstay bracket transmit forces from one buckstay to the other wall's tiebar. Bending forces which tend to bend each wall section are transmitted to each respective buckstay which resists such forces. Each buckstay is provided with at least one new anchor assembly having upper and lower support plates welded to the outside surface of the tubes and engaged with each buckstay, two pads welded to and spaced from each other on top of each support plate, and a U-shaped plate welded on top of each pad to form an aperture. A first extended standoff nearest the corner is welded directly to one tie bar and its upper and lower ends are received within apertures formed by the U-shaped plates. A second extended standoff welded to a bumper plate and also to the tie bar moves in the space between the pads. A third extended standoff's upper and lower ends are received within apertures formed by the other U-shaped plates and is engaged to its associated buckstay.

6 Claims, 5 Drawing Sheets

FIG. 5A
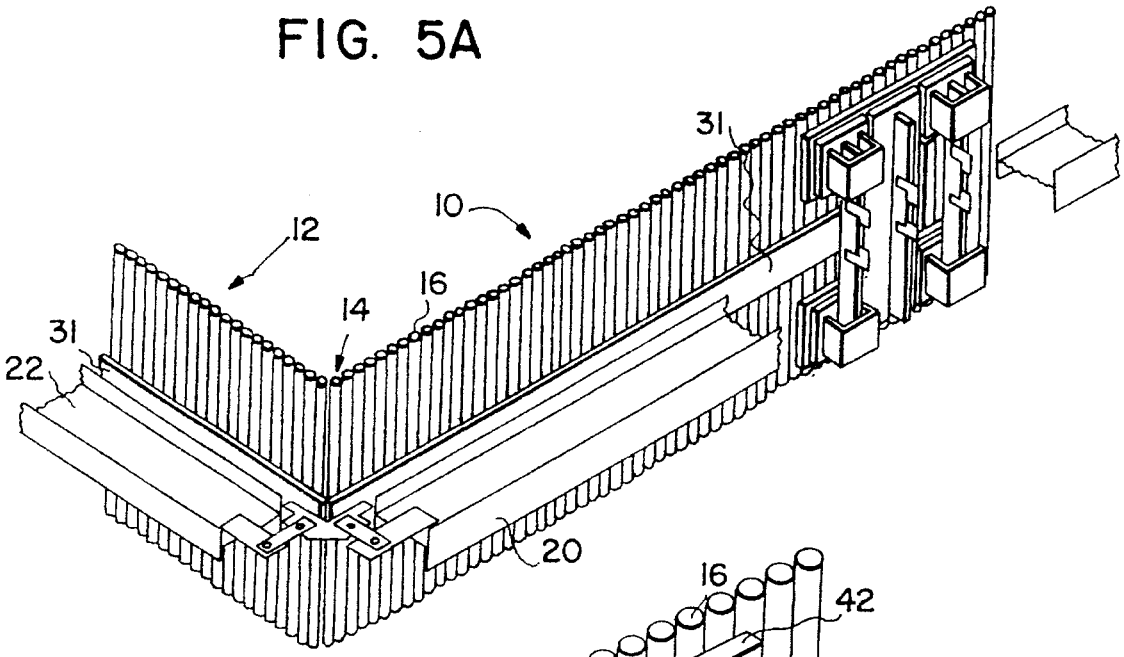
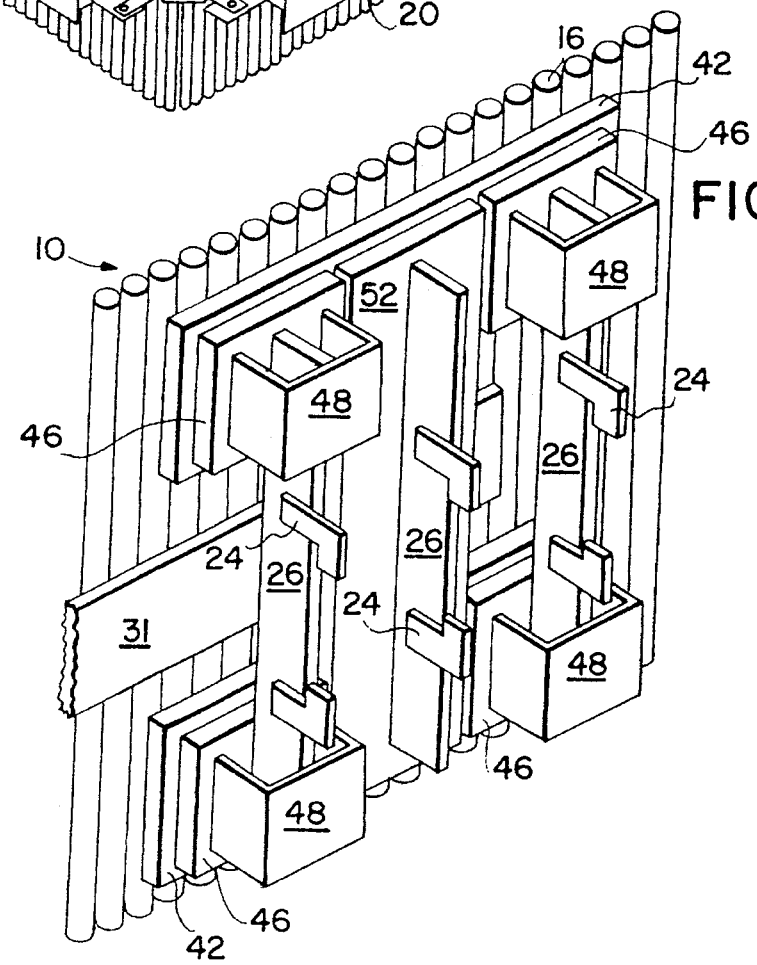
FIG. 5B

BOILER BUCKSTAY SYSTEM

FIELD AND BACKGROUND OF THE INVENTION

The present invention relates in general to the support structure for so-called membraned-tube walls in boilers and, in particular, to a new and useful buckstay system for supporting the membraned-tube walls in such a way that tube failures are reduced, particularly those failures which occur because of boiler start up and cool down operations.

Boiler buckstay systems are constructed of rolled steel members and/or trusses that stiffen the boiler tube walls. The boiler tube walls are subjected to combustion gas pressures which can be either positive or negative with respect to the local atmospheric pressure. The combustion gas pressure is contained by connecting the buckstays on opposite walls by bars, rods or channels to balance the resulting tension loads (pressure firing) or compression loads (balanced-draft firing). Thermal expansion of the boiler walls is usually accommodated by various designs of links, slotted members, bolts and pins making the connection between the bars, rods or channels and the buckstays. For general discussion of this area, the reader is referred to Chapters 7 and 22 of Steam: its generation and use, © 1992 by The Babcock & Wilcox Company.

A brief discussion of the structures to which the present invention is applicable can be had by referring to FIGS. 1 and 2 of the present disclosure. FIGS. 1 and 2 are perspective views of a conventional boiler corner construction in the "cold" position—i.e., the boiler pressure parts and structural members are at ambient temperature. A first wall section 10 meets a second wall section 12 at an angle to form a corner 14. Each wall section 10, 12 is comprised of multiple vertically extending tubes 16 which are spaced from and welded to each other by membrane plates 18. Fluid conveyed through the tubes 16 during boiler operation absorbs heat from the combustion gases. A buckstay system is provided on the outside of the walls 10, 12, and comprises at least one buckstay 20, 22 for each wall section 10, 12, respectively. In an actual boiler construction, buckstays 20, 22 are repeated at intervals along the vertical height of the wall sections 10, 12. The buckstays 10, 12 resist bending forces which the wall sections 10, 12 experience during boiler steady state and transient operating conditions. These bending forces are due to both external loads, such as wind and earthquake, and to boiler gas side pressure, which can be either positive or negative with respect to local atmospheric pressure.

Standoff means in the form of support lugs 24 and standoffs 26 are engaged along an inner flange 28 of each buckstay 20, 22. Relative sliding movement between the standoff means 24, 26 and the buckstays 20, 22 is permitted to accommodate thermal expansion.

In FIG. 1, two continuous tie bars 30 are welded to the edge of each standoff 26. Tie bars 30 can, in some applications, alternatively comprise a channel member (not shown). Engagement means in the form of L-shaped engagement lugs 32 are welded to the outside surface of some of the horizontally spaced tubes 16 forming each wall section 10, 12. The engagement lugs 32 are welded to the tubes in facing pairs to form a slot which closely receives each continuous tie bar 30. The engagement means can also comprise a pair of clips as shown in sub-illustration (FIG. 1A), one located above and the other below each continuous tie bar 30, together with a tie bar pin. The clips would be welded to two adjacent tubes 16 to form a loop that extends out beyond the outer surface of the continuous tie bar 30. When the tie bar pin is inserted between the loop and the continuous tie bar 30, the latter is held in place against the wall sections 10, 12. The engagement means thus supports the weight of the buckstays 20, 22 which, in effect, hang on the wall sections 10, 12.

An end connection corner tie 34 spans the corner 14 and is welded to the continuous bars 30. An end connection buckstay bracket 36 is welded to each end of the buckstays 20, 22 near corner 14. A pair of end connection links 38 is pivotally connected by pins 40 between the end connection corner tie 34 and each end connection buckstay bracket 36. Suitable circular holes are provided in each member 34, 36, 38 for these pins 40 to allow for thermal expansion of the wall sections 10, 12. To explain, FIGS. 1 and 2 show the corner construction in a "cold" position before the tube wall sections 10, 12 have expanded. In this condition, each link 38 forms a small acute angle with the edge of its buckstay 20, 22 (the edge extending perpendicular to the plane of the wall sections 10, 12). In a "hot" condition, each of the links 38 would extend approximately parallel to the edge of its buckstay 20, 22, and the forces from one wall section 10, for example, would be transmitted to the tie bar 30 of the adjacent wall section 12.

Boiler walls constructed of welded membraned-tube panels (tubes which are welded together in various geometric patterns) can be utilized to balance the combustion gas pressure loads between opposite walls in lieu of bars, rods and/or channels. Referring to FIG. 2, one such design utilizes a paddle tie 42 (a short bar welded to an adjacent boiler wall instead of a continuous bar), to connect the buckstays to adjacent membraned-tube walls that carry the buckstay system tension or compression loads. FIG. 2 thus differs from FIG. 1 in that one of the two continuous tie bars 30 are replaced by a support bar 30' separated from a corner paddle tie 42 welded at the corner 14 to the tubes 16 forming the wall section 10. A continuous tie bar 30 is still provided on the other wall section 12.

Buckstay systems with continuous tie bars, rods or channels on membraned-tube walls experience temperature differentials between the tie bars, etc., and tube walls that are of sufficient magnitude to cause failure in the tube walls and/or buckstay system during transient operation of the boiler (start up and cool down).

Buckstay systems with paddle ties 42 have relatively few temperature differential problems. However, it is difficult and, sometimes, impossible to distribute large, concentrated combustion gas pressure loads from the rolled members, etc. through the short bars into the adjacent membraned-tube wall.

Some buckstay and membraned-tube wall attachment structures are disclosed in U.S. Pat. Nos. 4,721,069; 4,499,860; 4,395,860; and 4,059,075. While these references disclose mechanisms for accommodating expansion and contraction of the membraned-tube wall, they do not teach an arrangement for avoiding failures in the wall near a corner of the wall construction.

Corner support arrangements for a membraned-tube wall are disclosed in U.S. Pat. Nos. 4,008,691 and 3,479,994 in conjunction with solid structures that extend across the corner.

SUMMARY OF THE INVENTION

The purpose of the present invention is to eliminate (1) tube failures and (2) buckstay system, component-part failures that occur as a result of boiler start up and cool down, due to temperature-differential caused movements between the membraned tube walls and the buckstay system. This is done, according to one aspect of the present invention, by a buckstay system for a membraned-tube wall of a steam generator which more efficiently spreads the load from one wall section to an adjacent one.

It is a constant goal of boiler makers and the utility industry to improve the availability of their power generation equipment. Tube failures require the boiler to be removed from service which is costly in itself but especially so relative to the resulting lost generation of power. Eliminating tube failures is a major part of boiler availability improvement. The present invention can reduce or eliminate tube failures in boiler membrane-walls due to excessive stress levels caused by start up and cool down temperature induced differential movements between the walls and the boiler buckstay system. Buckstay systems parts failures can also be reduced or eliminated. The invention will have the most effect on once-through boilers due to their ability to be force-cooled. However, the present invention would also apply to natural circulation, i.e., drum-type boilers since tube failures have also been experienced in membraned-tube walls of drum-type boilers. It can be used on new boilers as well as on existing boilers to resolve problems or as part of the extensive upgrade work now prevalent throughout the utility industry.

Accordingly, one aspect of the present invention is drawn to a buckstay system for a membraned-tube wall of a steam generator having a first wall section which meets a second wall section at an angle to form a corner. At least one buckstay extends across at least part of each wall section. A pair of tie bars is welded to each other at the corner. An end connection corner tie is welded at the corner to the pair of tie bars, and a pair of end connection buckstay brackets are provided, one end of each being welded to each end of the buckstays near the corner.

A pair of end connection links is connected by pins at one end to the end connection corner tie and at the other end to the end connection buckstay bracket, so that forces from one buckstay are transmitted through the links to the other tie bar. Engagement means, engaged with each buckstay, transmit bending forces which tend to bend each wall section to each respective buckstay which resists such bending forces, and also transmit the weight of each buckstay to a respective wall section supporting each buckstay.

For each buckstay, at least one new anchor assembly is provided. Upper and lower support plates are welded to the outside surface of the tubes, engaged with each buckstay by the engagement means. Two pads are welded to and spaced from each other on top of each support plate, and a U-shaped plate is welded on top of each pad to form an aperture. Three extended standoffs are also provided. The extended standoff nearest the corner has an inner edge welded directly to one tie bar and has its upper and lower ends received within the apertures formed by one U-shaped plate on each upper and lower support plate. A second standoff is welded to a bumper plate that is also welded to the tie bar and moves in the space between the pads. A third standoff's upper and lower ends are received within the apertures formed by the other U-shaped plates on the upper and lower support plates and engaged by the engagement means with its associated buckstay.

The various features of novelty which characterize the invention are pointed out with particularity in the claims annexed to and forming a part of this disclosure. For better understanding of the invention, its operating advantages and specific results attained by it uses, reference is made to the accompanying drawings and descriptive matter in which preferred embodiments of the invention are illustrated.

BRIEF DESCRIPTION OF THE DRAWINGS

In the drawings:

FIG. 5A is a perspective view of the present invention as applied to a boiler wall 10, illustrating how the anchor assembly of the present invention can be located a distance away from the boiler corner to enhance transferral of forces to the wall 10 while minimizing buckling;

FIG. 5B is a close-up perspective view of the anchor assembly of the present invention shown in FIG. 5A;

DESCRIPTION OF THE PREFERRED EMBODIMENTS

Figure 3:
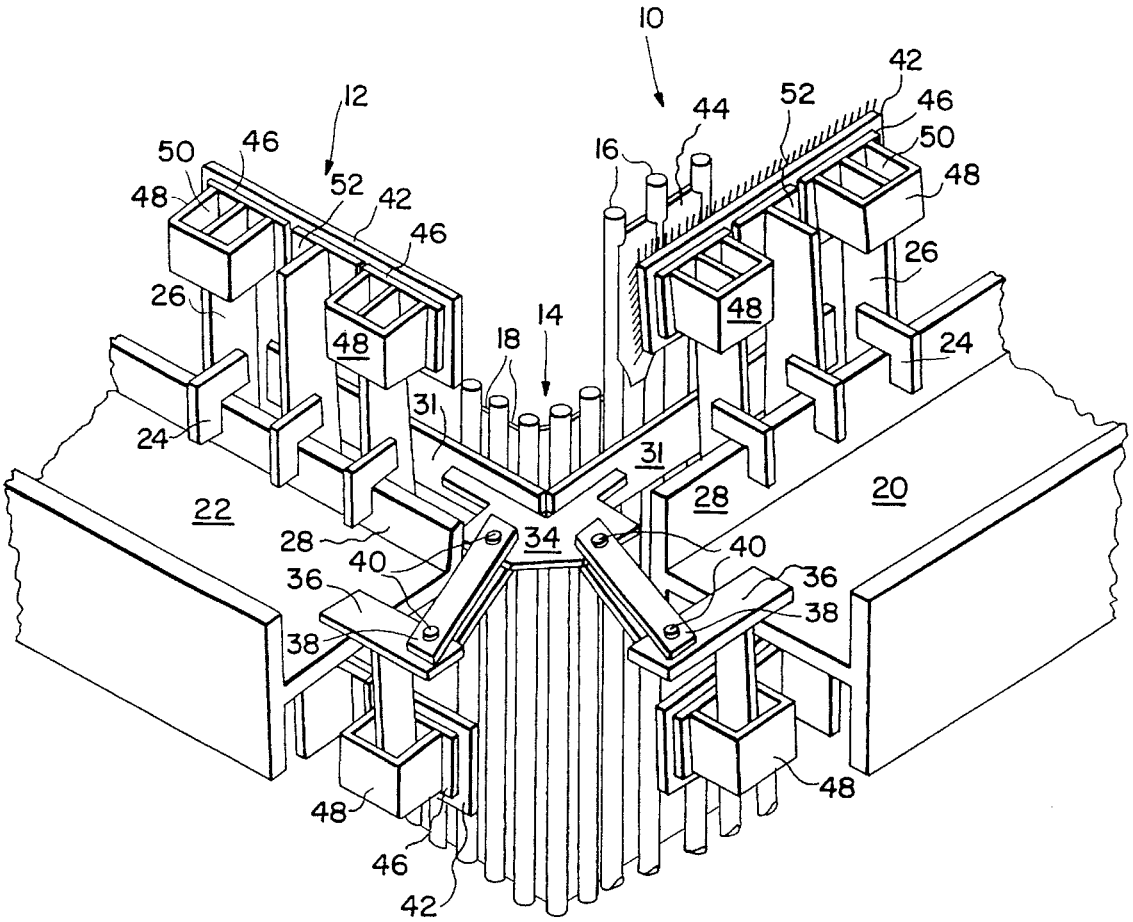
FIG. 3 is a perspective view of similar to that of FIG. 2, also shown in the "cold" position, showing how the new anchor assembly of the present invention provides an extending standoff mechanism which more efficiently spreads the load from one wall section to an adjacent wall section forming a corner.

Referring to the drawings generally, wherein like numerals designate the same or functionally similar elements throughout the several drawings, and to FIG. 3 in particular, the invention embodied in FIG. 3 comprises a buckstay system for a membraned-tube wall having a first wall section 10 which meets a second wall section 12 at an angle to form a corner 14. Each wall section is comprised of multiple vertically extending tubes 16 which are spaced from and welded to each other by membrane plates 18, welded inbetween adjacent tubes 16.

The buckstay system of the present invention comprises at least one buckstay 20, 22 for each respective wall section 10, 12. In an actual boiler construction, buckstays 20, 22 are repeated at intervals along the vertical height of the wall sections 10, 12.

The purpose of the buckstays 20, 22 is to resist bending forces which the wall sections 10, 12 experience during boiler steady state and transient operation conditions. These bending forces are due to both external loads, such as wind and earthquake, and to boiler gas side pressure, which can be either positive or negative with respect to local atmospheric pressure.

Standoff means in the form of support lugs 24 and extended standoffs 26 are engaged along an inner flange 28 of each buckstay 20, 22. Relative lateral sliding or shifting movement between the standoff means 24, 26 and the buckstays 20, 22 is permitted to accommodate thermal expansion.

Two tie bars 31 extend out from the corner 14 along each wall 10, 12 and are welded to each other at the corner 14. An end connection corner tie 34 spans the corner 14 and is welded to the tie bars 31. An end connection buckstay bracket 36 is welded to each end of the buckstays 20, 22 near the corner 14. A pair of end connection links 38 is pivotally connected by pins 40 between the end connection corner tie 34 and each end connection buckstay bracket 36. Suitable circular holes are provided in each member 34, 36, 38 for this purpose to allow for thermal expansion of the wall sections 10, 12. FIG. 3 shows the corner construction in a "cold" position before the tube wall sections 10, 12 have expanded. In this condition, each link 38 forms a small acute angle with the edge of its buckstay 20, 22 (the edge extending perpendicular to the plane of the wall sections 10, 12). In the "hot" condition, each of the links 38 would extend approximately parallel to the edge of its buckstays 20, 22, and the forces from one wall section 10, for example, would be transmitted to the buckstay 20 and into the adjoining tie bar 31.

A key aspect of the present invention is the new anchor assembly which provides for more efficient spread of load from one wall section to an adjacent one. Plural support plates 42 are welded to the outside surface of the tubes 16 forming each wall section 10, 12. Filler bars 44 may be welded inbetween adjacent tubes 16, on top of the membrane 18, to provide for greater surface area for welding the plural support plates 42 to the tubes 16.

Figure 4:
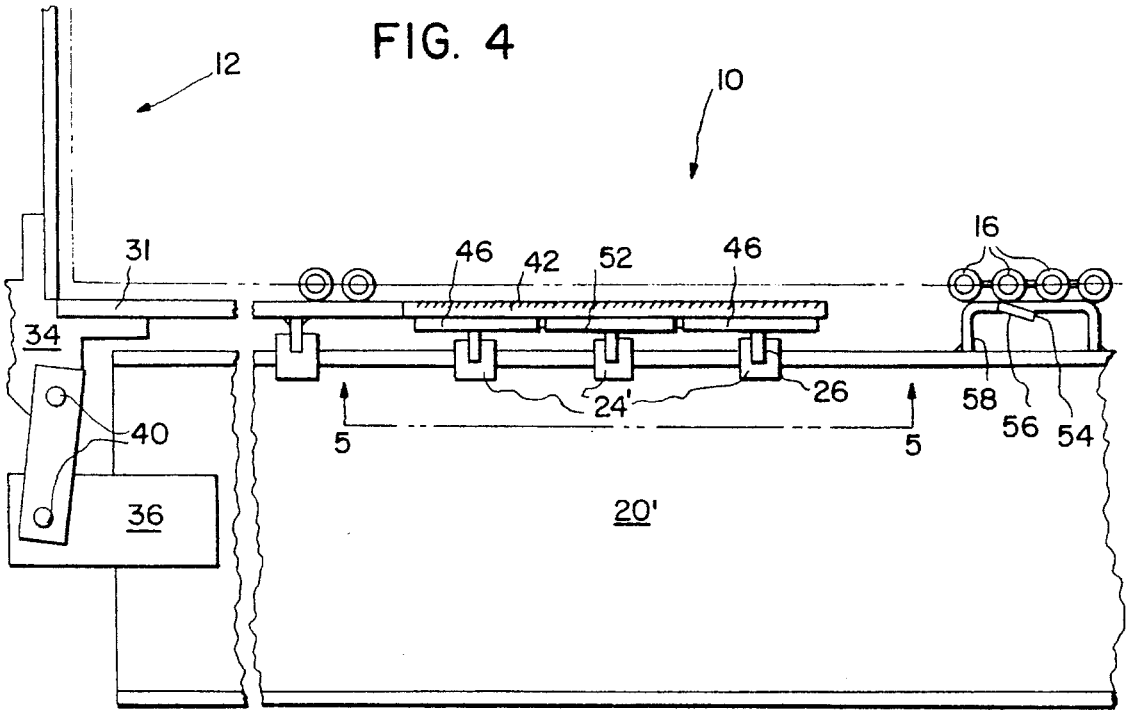
FIG. 4 is a partial, top plan view of the embodiment of FIG. 3.
Figure 5:
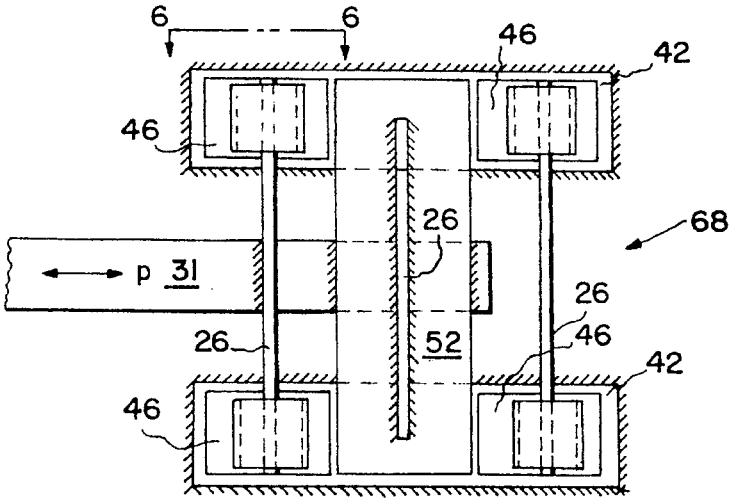
FIG. 5 is an elevational view taken along line 5—5 of FIG. 4, the buckstay being omitted for clarity.

In a preferred embodiment, two rectangular support plates 42, an upper one and a lower one, are employed above and below buckstays 20, 22. Typical dimensions are shown in FIG. 5. An important feature of the invention is that the support plates 42 can be located on the walls 10, 12 at some distance from the corner 14, typically about 10'. FIGS. 5A and 5B illustrate this aspect. The 10' distance provides an advantage because the forces can be transferred to the membrane-tube walls 10, 12 at locations where the load can be more efficiently disbursed into the walls. That is, the membrane-tube wall has a higher load capability when loaded in its interior, away from the corner 14, than it does when it is loaded near the corner 14. Pads 46 are welded on top of the support plates 42, one at each end. Each pad 46 has the two ends of a U-shaped plate 48 welded on top to form an aperture 50. Standoff means in the form of the extended standoffs 26 and support lugs 24 (FIG. 3) or 24' (FIG. 4) are provided, engaged along the inner flange 28 of each buckstay 20, 22.

Figure 6:
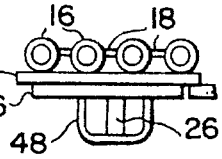
FIG. 6 is a top detail view taken along line 6—6 of FIG. 5.

Three such extended standoffs 26 are associated with each pair of upper and lower support plates 42. The extended standoffs 26 provide a moment resisting function. The moment being resisted is generated by an eccentric load path. As the load is transferred from the tie bar 31 to the wall 10 or 12, it must bridge an eccentricity equal to the tube radius plus half of the pad 46 thickness plus the support plate 42 thickness. Without the extended standoffs 26, the load capacity of the structure would be limited to a smaller level because the wall is so weak when loaded in that particular way. The first extended standoff 26, nearest the corner 14, has an inner edge welded to the tie bar 31, and the upper and lower ends of the standoff 26 are received within apertures 50 created by one pair of U-shaped plates 48. FIG. 6 shows a top detail view of the upper end of this first standoff 26.

Figure 1:
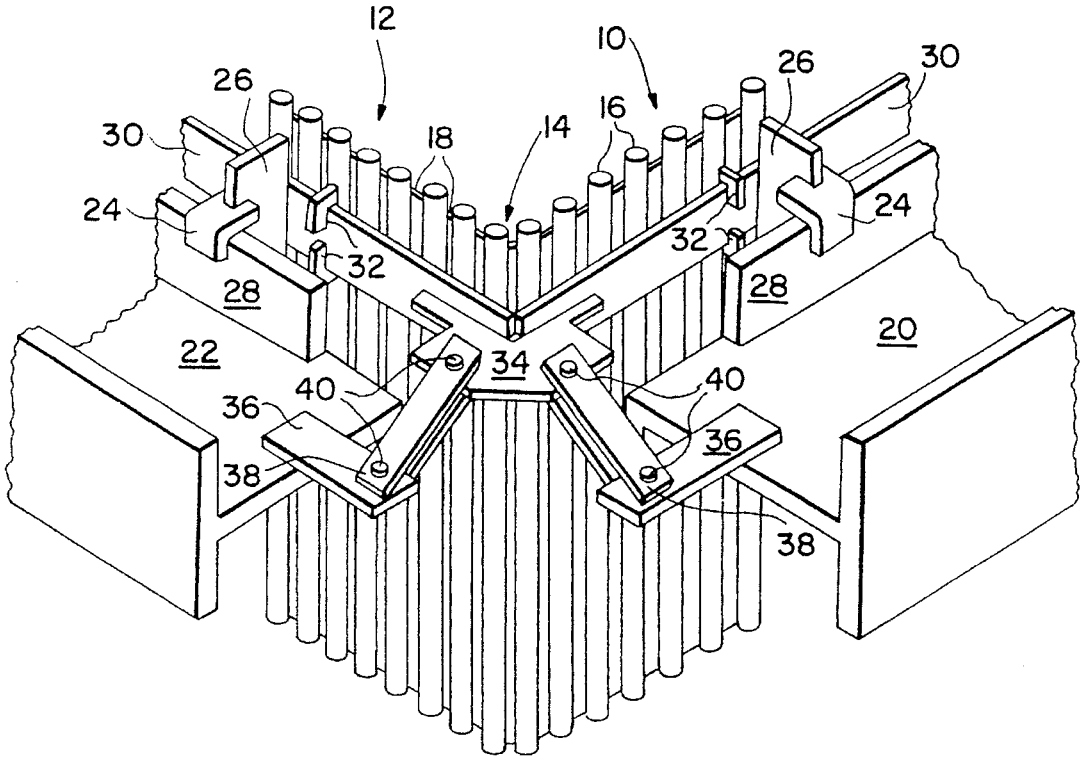
FIG. 1 PRIOR ART
FIG. 1 is a perspective view of a known buckstay system corner construction, shown in the "cold" position, utilizing a tie bar which extends continuously around the corner formed by two wall sections.
Figure 2:
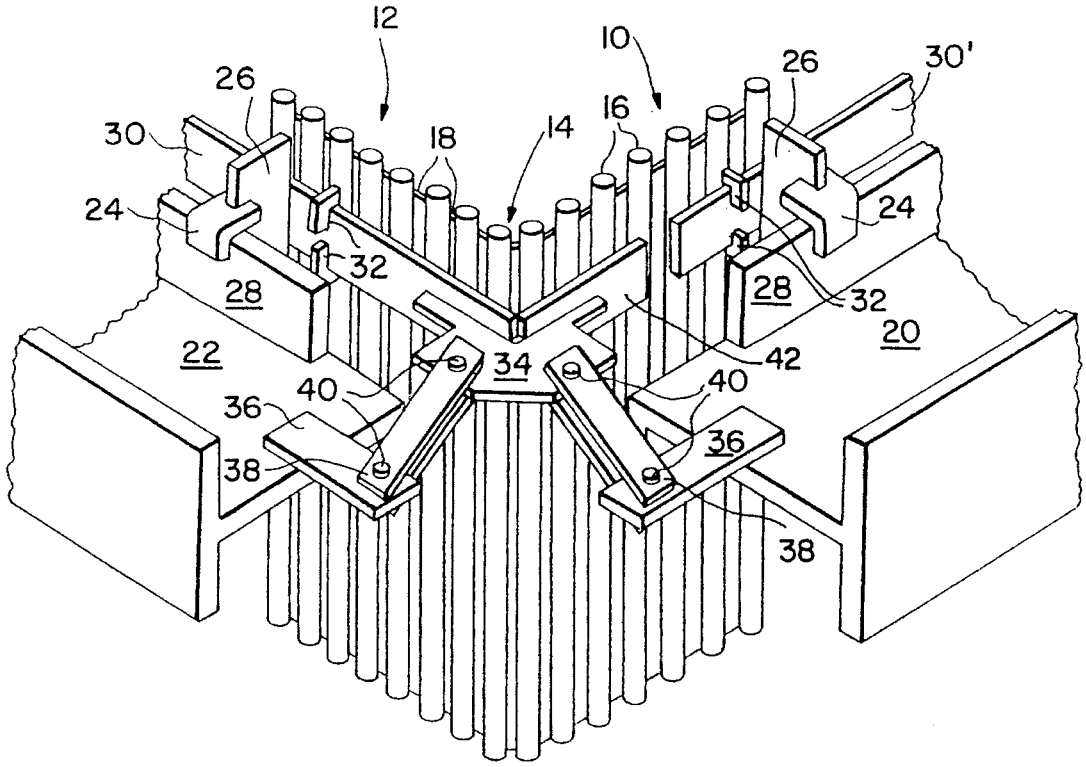
FIG. 2 PRIOR ART
FIG. 2 is a perspective view of another known buckstay system corner construction, shown in the "cold" position, utilizing a tie bar which does not extend continuously around the corner.
Figure 1A:
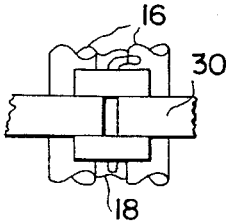
FIG. 1A PRIOR ART
FIG. 1A is a view of an alternative known form of engagement means 32 of FIG. 1.

The middle or second extended standoff 26 is welded to a bumper plate 52, which, in turn, is also welded to the tie bar 31, as shown. The vertical height or length of the bumper plate 52 is approximately the same as that of the extended standoffs 26; its thickness is about the same as that of the pads 46 on either side. The width of the bumper plate 52 is slightly less than the distance between the pads 46 on each upper and lower support plate 42 to provide for relative sliding movement between each pad 46 and the bumper plate 52. The symbol P in FIG. 5 represents the load end reaction applied to tie bar 31 by the adjacent buckstay 22. With reference to FIG. 5, positive pressure loadings of the boiler wall sections 10, 12 will cause the bumper plate 52 to bear against the left upper and lower pads 46; on negative pressure loadings, the bumper plate 52 will bear against the right upper and lower pads 46. It will be noted that FIG. 4 illustrates the alternative form of engagement means referred to in the earlier discussion of FIGS. 1 and 1A. As shown in FIG. 4, the engagement means for buckstay 20, 22 to a wall section 10, 12 can also comprise clips 54 welded to two adjacent tubes 16 to form a loop. A pin 56 is inserted between the loop and a buckstay U-plate 58 to hold the buckstay 20 against the wall section 10. As mentioned in the description of FIG. 1, the pin 56 could also be inserted between the loop and a tie bar or channel 31.

The third extended standoff 26 has its upper and lower ends received within the apertures 50 formed by the pair of U-shaped plates 48 located on the right hand side of FIG. 5. It is attached to the buckstay 20 by means of support lugs 24 or 24', as shown.

Figure 7:
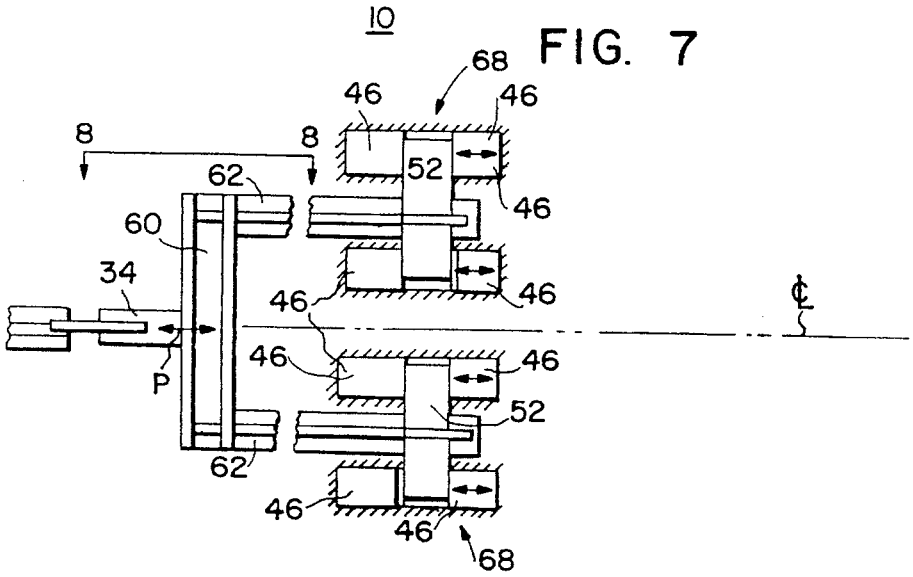
FIG. 7 is a side elevational view of another embodiment of the invention, the buckstay again being omitted for clarity, which shows how a load P from one wall section forming the corner can be spread into the other wall section forming the corner by means of multiple anchor assemblies, one above and the other below, the buckstay.
Figure 9:
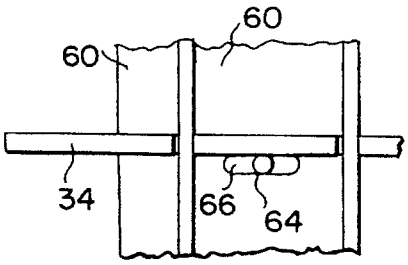
FIG. 9 is a detail view taken along line 9—9 of FIG. 8.
Figure 8:
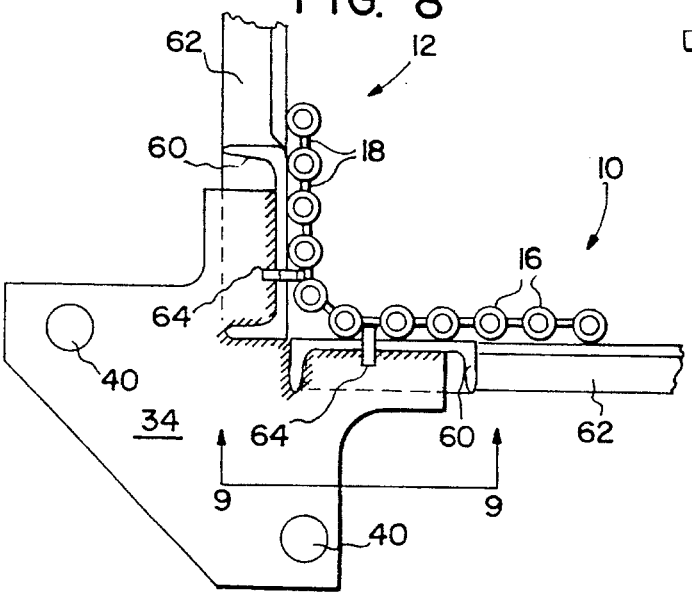
FIG. 8 is a top plan detail view taken along line 8—8 of FIG. 7.

FIGS. 7–9 illustrate another aspect of the present invention which shows an embodiment using plural anchor assemblies of the type shown in FIGS. 3–6. In this embodiment, a given load end reaction P can be divided into four equal load end reactions of magnitude P/4 and applied to the wall section 10.

The end load reaction P from wall section 12 would be applied to wall section 10 through the end connection corner tie 34 into a vertical channel 60 which, in turn, is welded to a pair of horizontal bars or channels 62. The vertical channels 60 partially support the end connection corner tie 34 by means of studs 64 attached to each wall section 10, 12 and which are slidably received through horizontal slots 66 in each vertical bar or channel 60. Each horizontal bar or channel 62 is fixed to a wall section 10, 12 by an anchor assembly 68 of the type shown in FIGS. 4–6.

While specific embodiments of the invention have been shown and described in detail to illustrate the application of the principles of the invention, it will be understood that the invention may be embodied otherwise without departing from such principles.

We claim:

1. A buckstay system for a membraned-tube wall of a steam generator having a first wall section which meets a second wall section at an angle to form a corner, the system comprising:

at least one buckstay extending across at least part of each wall section;

a pair of tie bars welded to each other at the corner;

an end connection corner tie welded at the corner to the pair of tie bars;

a pair of end connection buckstay brackets, one end of each welded to each end of the buckstays near the corner;

a pair of end connection links connected by pins at one end of the end connection corner tie and at the other end to the end connection buckstay bracket, so that forces from one buckstay are transmitted through the links to the tie bars;

engagement means, engaged with each buckstay, for transmitting bending forces which tend to bend each wall section to each respective buckstay which resists such bending forces, and for transmitting the weight of each buckstay to a respective wall section supporting each buckstay; and for each buckstay, at least one anchor assembly having upper and lower support plates welded to the outside surface of the tubes, engaged with each buckstay by the engagement means and including two pads welded to and spaced from each other on top of each support plate, a U-shaped plate welded on top of each pad to form an aperture, a first extended standoff located nearest the corner having an inner edge welded directly to one tie bar and having its upper and lower ends received within the apertures formed by one U-shaped plate on each upper and lower support plate, a second extended standoff welded to a bumper plate which is also welded to the tie bar and moves in the space between the pads, and a third extended standoff having its upper and lower ends received within the apertures formed by the other U-shaped plates on the upper and lower support plates and engaged by the engagement means to its associated buckstay.

2. A buckstay system according to claim 1, wherein two such anchor assemblies are provided at the corner for each buckstay, one being located above and the other below each buckstay.

3. A buckstay system according to claim 1, wherein the at least one anchor assembly is located at a distance from the corner formed by the first and second wall sections sufficient to prevent a buckling type failure of the wall sections.

4. A buckstay system according to claim 3, wherein said distance is approximately 10'.

5. In a buckstay system for a membraned-tube wall of a steam generator having a first wall section which meets a second wall section to form a corner, at least one buckstay extending across at least part of each wall section, a pair of tie bars welded to each other at the corner, and an end connection corner tie welded at the corner to the pair of tie bars, an arrangement of intercooperating end connection buckstay brackets, end connection links and pins for transmitting forces from one buckstay through the links to the other buckstay and engagement means for transmitting bending forces which tend to bend each wall section to each respective buckstay which resists such bending forces, and for transmitting the weight of each buckstay to a respective wall section supporting each buckstay, the arrangement further comprising:

at least one anchor assembly for each buckstay having upper and lower support plates welded to the outside surface of the tubes, engaged with each buckstay by the engagement means and including two pads welded to and spaced from each other on top of each support plate, a U-shaped plate welded on top of each pad to form an aperture, a first extended standoff located nearest the corner having an inner edge welded directly to one tie bar and having its upper and lower ends received within the apertures formed by one U-shaped plate on each upper and lower support plate, a second extended standoff welded to a bumper plate which is also welded to the tie bar and moves in the space between the pads, and a third extended standoff having its upper and lower ends received within the apertures formed by the other U-shaped plates on the upper and lower support plates, and engaged by the engagement means to its associated buckstay.

6. An anchor assembly for interconnecting a membrane-tube wall of a steam generator having a first wall section which meets a second wall section to form a corner, with a tie bar and a buckstay extending across at least part of said first wall to transmit bending forces which tend to bend said first wall to said buckstay which resists such bending forces, comprising:

upper and lower support plates adapted to be welded to said membrane-tube wall;

two pads welded to and spaced from each other on top of each upper and lower support plates;

a U-shaped plate welded on top of each pad to form an aperture;

a first extended standoff located nearest the corner having an inner edge adapted to be welded directly to one of said tie bars and having its upper and lower ends received within the apertures formed by the U-shaped plates on each upper and lower support plate;

a second extended standoff welded to a bumper plate which is adapted to be welded to said tie bar and which moves in the space between the pads; and a third extended standoff having its upper and lower ends received within the apertures formed by the other U-shaped plates on the upper and lower support plates, all of said extended standoffs being provided with engagement means for slidably engaging the anchor assembly with the buckstay.

* * * * *